US007443277B2

(12) United States Patent
Yamaguchi

(10) Patent No.: US 7,443,277 B2
(45) Date of Patent: Oct. 28, 2008

(54) COIL COMPONENT

(75) Inventor: Takayuki Yamaguchi, Tokyo (JP)

(73) Assignee: Sumida Corporation, Tokyo (JP)

( * ) Notice: Subject to any disclaimer, the term of this patent is extended or adjusted under 35 U.S.C. 154(b) by 88 days.

(21) Appl. No.: 11/424,322

(22) Filed: Jun. 15, 2006

(65) Prior Publication Data

US 2006/0284716 A1 Dec. 21, 2006

(30) Foreign Application Priority Data

Jun. 21, 2005 (JP) ..... P2005-180957

(51) Int. Cl.
*H01F 27/30* (2006.01)
*H01F 27/02* (2006.01)

(52) U.S. Cl. ..... 336/208; 336/198; 336/83; 336/212

(58) Field of Classification Search ..... 336/198, 336/208, 192, 83, 212, 90, 92, 96
See application file for complete search history.

(56) References Cited

U.S. PATENT DOCUMENTS 4,656,450 A * 4/1987 Jarosz et al. ..... 336/83
4,888,571 A * 12/1989 Kobayashi et al. ..... 336/65
5,952,907 A * 9/1999 McWilliams et al. ..... 336/83
6,958,673 B2 * 10/2005 Suzuki ..... 336/208

* cited by examiner

*Primary Examiner*—Anh T Mai
(74) *Attorney, Agent, or Firm*—Sonnenschein Nath & Rosenthal LLP

(57) ABSTRACT

A coil component including a flanged core having a flange portion on at least one end portion of winding core, a coil that is wound around the winding core, a bottomed cylindrical cup-shaped core consisting of a bottom portion and a circumferential wall portion, and at least two or more resin base members having metal terminals, wherein cut-out portions of at least two places or more are formed in the circumferential wall portion, and the resin base members are disposed along a lateral circumferential surface of the flange portion.

4 Claims, 7 Drawing Sheets

COIL COMPONENT

CROSS REFERENCES TO RELATED APPLICATIONS

The present application claims priority to Japanese Application No. P2005-180957 filed on Jun. 21, 2005, which application is incorporated herein by reference to the extent permitted by law.

BACKGROUND OF THE INVENTION

1. Field of the Invention

The present invention relates to a coil component and more particularly relates to a small and efficient transformer component.

2. Description of the Related Art

In recent years, a size reduction of a coil component has been strongly required due to a reason such as a substrate configuration of high density mounting and multilayer array, and at the same time it has been strongly required to reduce an electric current loss, more specifically to make efficiency higher.

In the past, a coil component which has been generally used is configured to have a ring-type core 103 that is made of a sintered compact of magnetic material, a flanged core 102, a coil 104 that is wound around a winding core of flanged core, and a resin base 105 in which metal terminals are buried as shown in FIG. 1A, for example, and a coil component 101 according to this configuration has such an advantage that a manufacturing cost of each constituent part is low and manufacturing stability is excellent (refer to Patent Reference 1).

However, when the ring-type core 103 and the flanged core 102 are assembled together, a magnetic flux leakage is not only generated naturally from a gap portion but also a magnetic flux leakage of no small quantity in magnetic flux Φx passing through an uppermost side and the vicinity thereof out of magnetic flux emitted from the flanged core 102 and absorbed into the ring core 103 as shown in FIG. 1B is generated at a seam of cores such as the one shown by X in this figure. In this case, an influence on electric characteristics (for example, inductance value and DC superimposed characteristic), which is caused by the magnetic flux leakage Φx from the gap portion, is calculated beforehand into a design of the coil component but the magnetic flux leakage Φx generated at the seam of cores is not calculated and becomes a main factor causing an error between an actual measurement value of the inductance and a design value thereof, and thereby there has been such a problem that a desired inductance value is not obtained.

Furthermore, due to a multilayer substrate array, there are also many cases in which a signal system circuit and the like are disposed in an upper portion of circuit substrate on which a coil component of power system such as a transformer component is mounted, and the magnetic flux leakage Φx generating from the seam of cores becomes a factor that causes a malfunction in signal processing electronic components mounted on the above-described signal system circuit.

Because of the above, it has been known to use a coil component 101' that is configured to have a so-called bottomed cylindrical cup-shaped core as shown in FIG. 2A, for example, in order to suppress a magnetic flux leakage mainly from an upper portion of coil component and also a magnetic flux leakage from a seam of cores (refer to Patent Reference 2).

[Patent Reference 1] Japanese Published Patent Application No. H07-066042

[Patent reference 2] Japanese Published Patent Application No. 2000-082623

SUMMARY OF THE INVENTION

However, in the coil component 101' having such configuration, it becomes possible to suppress the magnetic flux leakage from the upper portion of coil component but in case of further attempting to obtain a coil component whose electric current loss is smaller, there arises such a problem that a loss portion of magnetic flux leakage generating from a gap that is provided between a bottomed cylindrical cup-shaped core 103 and a drum-type core 102 becomes remarkable at a position shown by X in FIG. 2A. More specifically, the magnetic flux leakage is generated in magnetic flux Φx passing through an lowermost side and the vicinity thereof out of magnetic flux Φ that are emitted from the drum-type core 102 and absorbed into the bottomed cylindrical cup-shaped core 103 after passing through the gap as shown in FIG. 2B.

Furthermore, in case of attempting a size reduction of the coil component, there arises such a problem that a height of the overall coil component becomes large since the coil component 101' is configured such that the flanged core 102 and the bottomed cylindrical cup-shaped core 103 are mounted on an upper portion of resin base 105 having metal terminals.

In consideration of the above-described problems, the present invention is to provide with a coil component whose size is small and also whose electric current efficiency is high by suppressing a useless magnetic flux leakage generating from a seam of cores and a gap portion.

A coil component according to an embodiment of the present invention is configured to have a flanged core having a flange portion on at least one end portion of winding core, a coil that is wound around the above-described winding core, a bottomed cylindrical cup-shaped core consisting of a bottom portion and a circumferential wall portion, and at least two or more resin base members having metal terminals, wherein the coil component is configured such that cut-out portions of at least two places or more are formed in the above-described circumferential wall portion and at the same time the above-described resin base members are disposed along a lateral circumferential surface of the above-described flange portion.

Desirably, it is suitable that a height of the above-described circumferential wall portion of bottomed cylindrical cup-shaped portion is larger than a height of the above-described flanged core.

More desirably, it is suitable that projection portions stretching over the circumferential wall portion and the bottom surface portion are provided to at least three places or more in the above-described bottomed cylindrical cup-shaped core.

The coil component according to the embodiment of the present invention is small in size since a dimension in height direction is held down, and also is excellent in electric current efficiency since the useless magnetic flux leakage is suppressed so that almost all the magnetic flux flowing in the coil component contributes to the electric characteristics.

According to the coil component related to the embodiment of the present invention, it is possible to reduce the size of the coil component since the dimension in height direction can be held down. In addition, it is possible to realize the coil component of high electric current efficiency by suppressing the useless magnetic flux leakage generating from the seam of cores and the gap portion.

DESCRIPTION OF THE PREFERRED EMBODIMENTS

Hereinafter, a preferred embodiment of the present invention is explained by referring to the accompanied drawings but the present invention is not limited to the following embodiment.

Figure 1A:
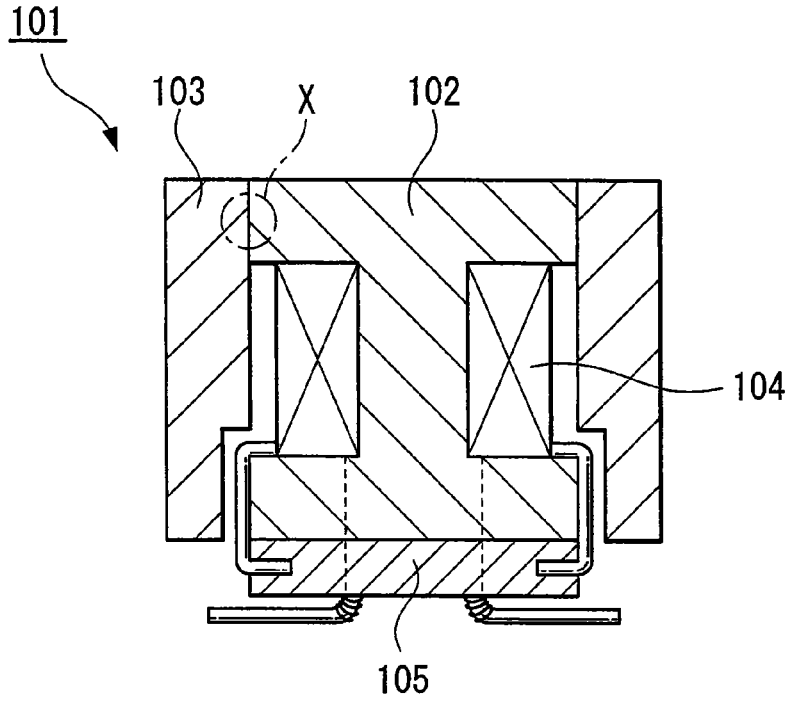
FIG. 1A (RELATED ART)
FIG. 1A is a cross-sectional view of a coil component in related art.
Figure 1B:
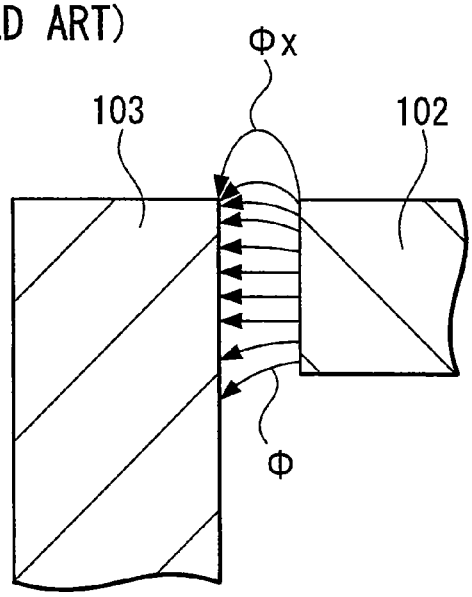
FIG. 1B (RELATED ART)
FIG. 1B is a schematic diagram showing an appearance of magnetic flux at a seam of cores of the coil component in related art.
Figure 2A:
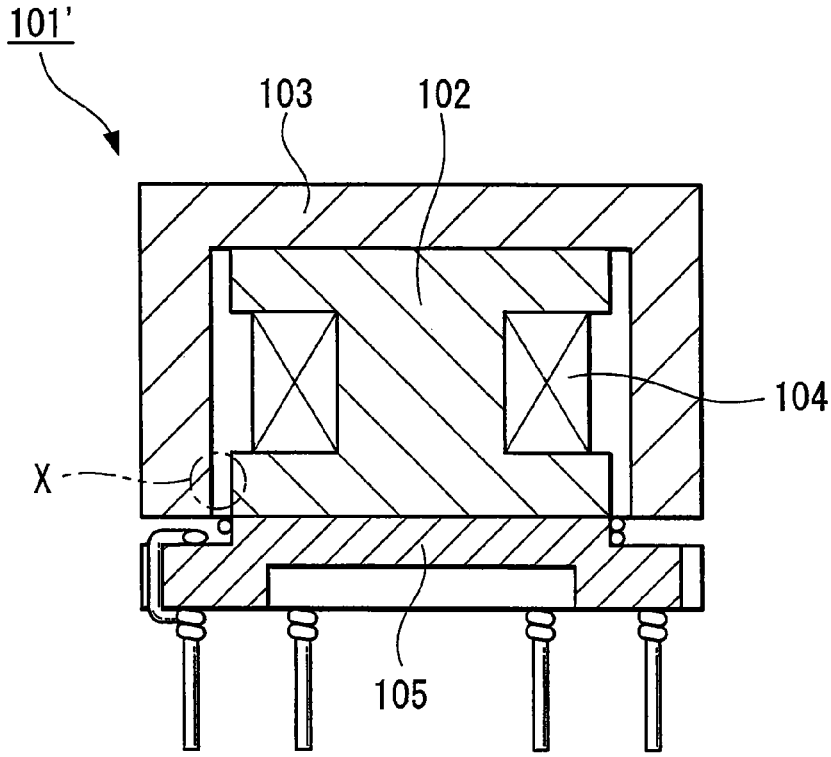
FIG. 2A (RELATED ART)
FIG. 2A is a cross-sectional view of a coil component in related art.
Figure 2B:
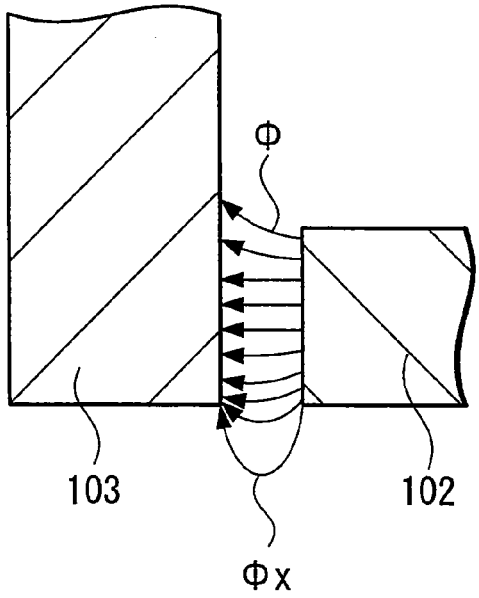
FIG. 2B (RELATED ART)
FIG. 2B is a schematic diagram showing an appearance of magnetic flux at a gap portion of coil component in related art.
Figure 3:
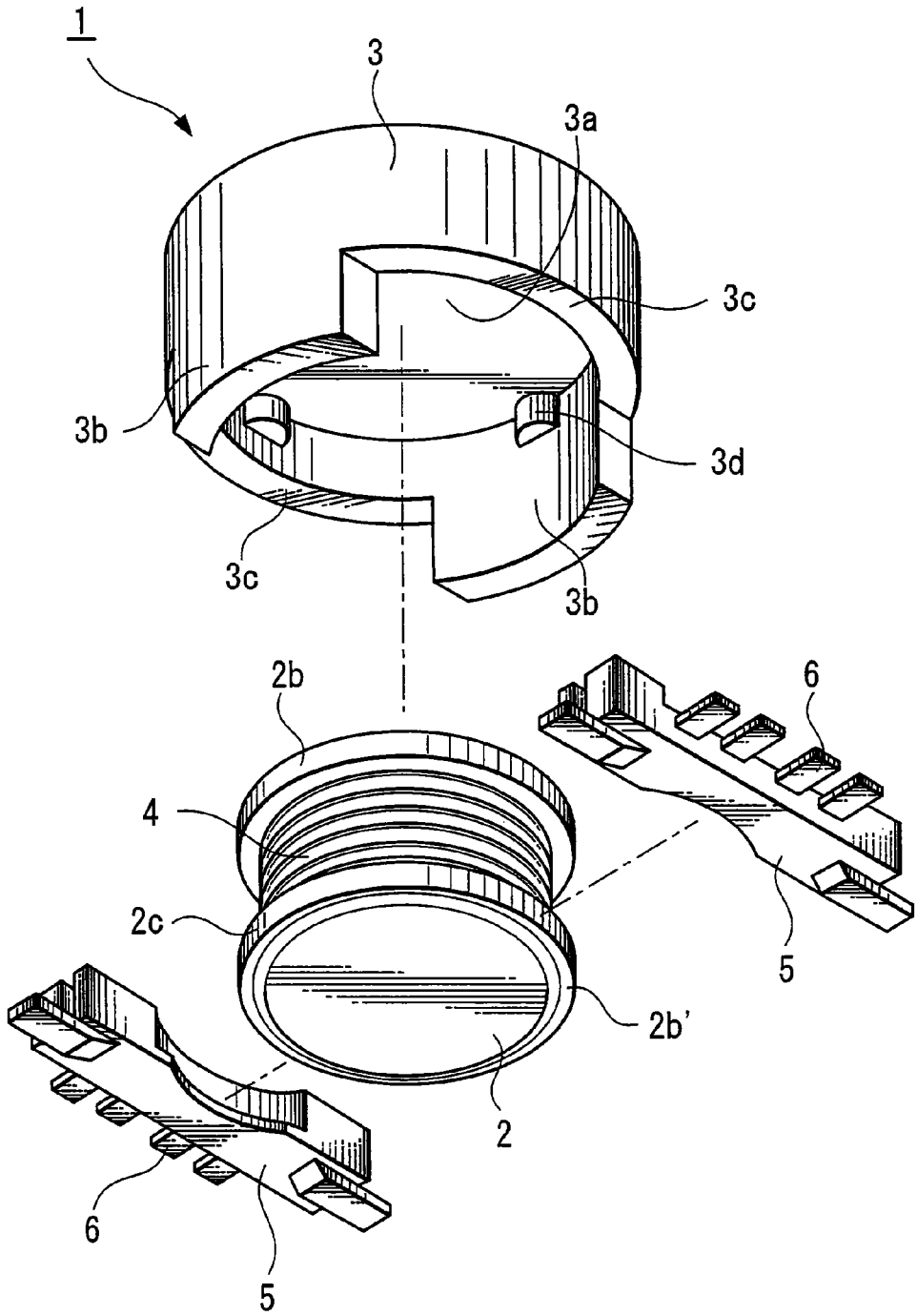
FIG. 3 is an exploded perspective view of a coil component according to an embodiment of the present invention.

FIG. 3 is an exploded perspective view of a coil component according to an embodiment of the present invention.

As shown in FIG. 3, a coil component 1 is configured to have a flanged core 2, a bottomed cylindrical cup-shaped core 3, a coil 4 and resin base members 5 having metal terminals 6.

The flanged core 2 is configured to have a winding core, which is not illustrated since the coil 4 is wound thereon, and flange portions 2*b* provided to both end portions of winding core. Here, the flanged core 2 may be configured such that the flange portion 2*b* provided to the winding core is provided to either one end portion of winding core. In addition, a level difference is formed in an edge of lateral circumferential surface of the lower side flange portion 2*b*'. It should be noted that the flanged core 2 is formed from a material using Ni—Zn type ferrite.

The bottomed cylindrical cup-shaped core 3 is configured to have a bottom portion 3*a* and a circumferential wall portion 3*b* provided integrally in a manner connecting integrally with that bottom portion 3*a*. In addition, the bottom portion 3*a* is provided with projections 3*d* for positioning the flanged core 2 when the flanged core 2 and the bottomed cylindrical cup-shaped core 3 are assembled together.

Furthermore, cut-out portions 3*c* for relieving the resin base members 5 installed to the flanged core 2 at the time of assembling together the flanged core 2 and the bottomed cylindrical cup-shaped core 3 is formed in a manner being disposed at symmetrical positions in the circumferential wall portion 3*b*. It should be noted that the cut-out portions 3*c* provided in the circumferential wall portion 3*b* are not limited to two places such as those in this embodiment but may be formed in two places or more according to the number of resin base members 5 which are installed to the flanged core 2.

The coil 4 is formed from a wire having an insulating cover film. In addition, both end portions of wire have coil terminal portions in order to flow electric current supplied from a later-described mounting substrate 7. It should be noted that the coil 4 is formed such that the wire is wound around the winding core 2*a* of the flanged core by rotating the flanged core 2.

The resin base members 5 are molded such that the metal terminals 6 are buried therein and shapes thereof become symmetric. In addition, the number of resin base members 5 is not limited to two pieces such as those in this embodiment but may be four pieces, for example. In this case, it should be noted that the bottomed cylindrical cup-shaped core 3 is formed such that the places of cut-out portion 3*c* provided in the circumferential wall portion 3*b* thereof become four places correspondingly to the number of resin base members 5. In addition, the left and right resin base members 5 may be molded into different shapes in order to make it easy to judge visually a mounting direction and the like onto the flanged core 2.

Figure 7A:
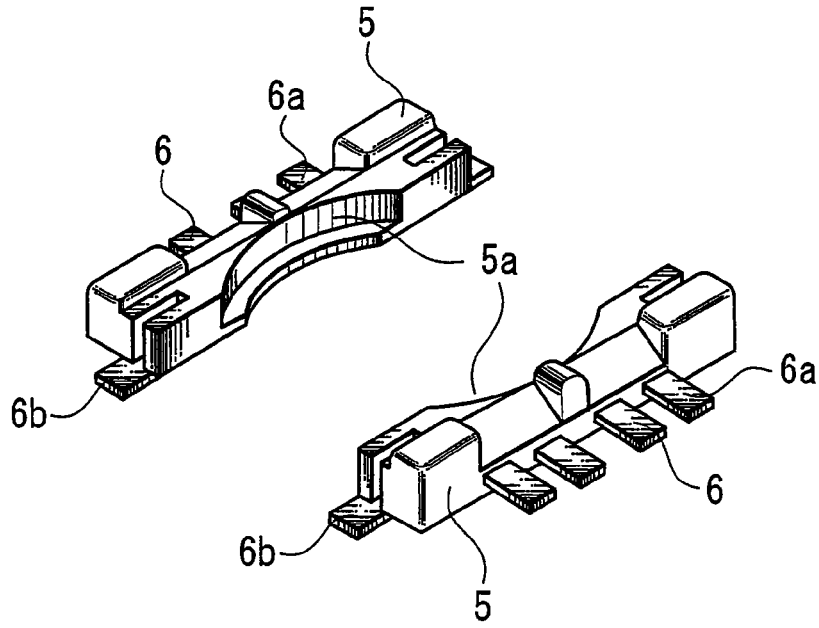
FIG. 7A is a perspective view of resin base members that are used in the embodiment of the present invention.
Figure 7B:
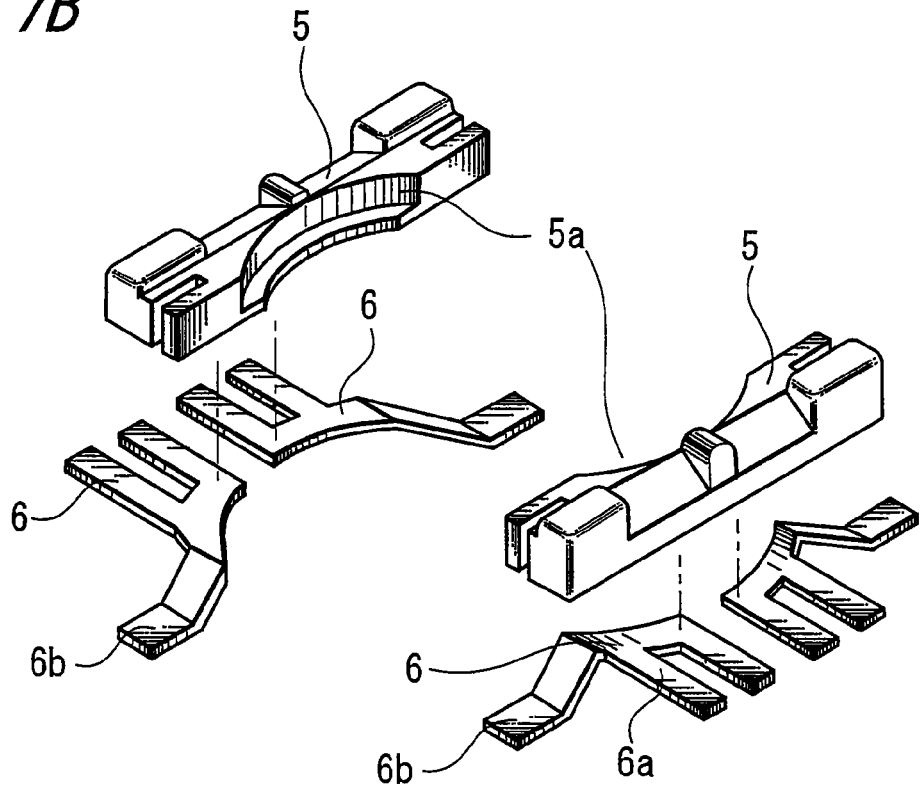
FIG. 7B is an exploded perspective view of the resin base members that are used in the embodiment of the present invention.

FIG. 7A is a perspective view of the resin base members 5 that are used in the embodiment of the present invention, and FIG. 7B is an exploded perspective view of the resin base members that are used in the embodiment of the present invention.

As shown in FIG. 7A, fitting concave portions 5*a* matched to a shape of the lateral circumferential surface 2*c* of the flange portion 2*b*' of flanged core is formed in the resin base members 5.

Since the shape of the resin base member 5 is thus matched to the shape of the lateral circumferential surface of the flange portion 2*b*' of flanged core, it is possible to reduce a mounting area of the coil component 1 to a mounting substrate 7 when the resin base members 5 are installed to the flanged core 2.

In addition, a plurality of coil terminals 6*a* and a mounting terminal 6*b* extending to a lower direction of the resin base member 5 are formed in the metal terminal 6 that is buried in the resin base member 5 as shown in FIG. 7B.

Also, the plurality of coil terminals 6*a* constitute tying portions to fix the coil terminal portions of coil 4 so that the coil terminal portions of coil 4 wound around the winding core 2*a* are tied thereto. In addition, the mounting terminal 6*b* conducts electricity between the mounting substrate 7 on which the coil component 1 is mounted and the coil 4.

Next, one example of manufacturing process of the coil component 1 according to the embodiment of the present invention is explained hereinafter.

First, a primary coil 4A is wound around the winding core 2*a* of the flanged core 2, and thereafter a secondary coil 4B is wound along an outermost circumferential surface of the primary coil 4A. Furthermore, the primary coil 4A is wound along an outermost circumferential surface of that secondary coil 4B in a similar manner to the one described above in order to form the coil 4. It should be noted that a linkage between the primary coil and the secondary coil can be enhanced by thus winding the coil 4 into 3 layers so that a transformer with higher efficiency can be obtained.

Next, the resin base members 5 are installed to the lateral circumferential surface 2*c* of the flange portion 2*b*' of flanged core 2, each coil terminal portion of primary coil 4A and secondary coil 4B is tied to the plurality of coil terminals 6*a* that are exposed from the metal terminal 6 buried in the resin base member 5, and that region is dipped into a solder bath so that the coil 4 and the coil terminal 6*a* are fixed by soldering.

Next, the bottomed cylindrical cup-shaped core 3 is fit and fixed to the coil-wound flanged core 2 and the resin base member 5 so that the coil component 1 is completed. Here, the coil component 1 is mounted on the circuit substrate 7 in such a state that the contact between the mounting terminal 6*b* and the circuit substrate is maintained by soldering. Thereby, an electric current supplied from the mounting substrate 7 is supplied from the coil terminal portion to the coil component 1 through the mounting terminal 6*b*. It should be noted that the coil component of this embodiment is not limited to the above-described process but may be processed such that the resin base members 5 are installed to the lateral circumferential surface 2*c* of the flange portion 2*b*' of flanged core 2 on the first stage, then the coil 4 is wound around the winding core, and thereafter the bottomed cylindrical cup-shaped core 3 is arranged.

Thus, since at least two resin base members 5 are disposed in a separated state on the flange portion 2*b*' of flanged core 2 according to the coil component 1 of this embodiment, a thickness of the resin base member 5 is not added to a height direction of the coil component and it is possible to lower an overall height dimension of the coil component.

Figure 4A:
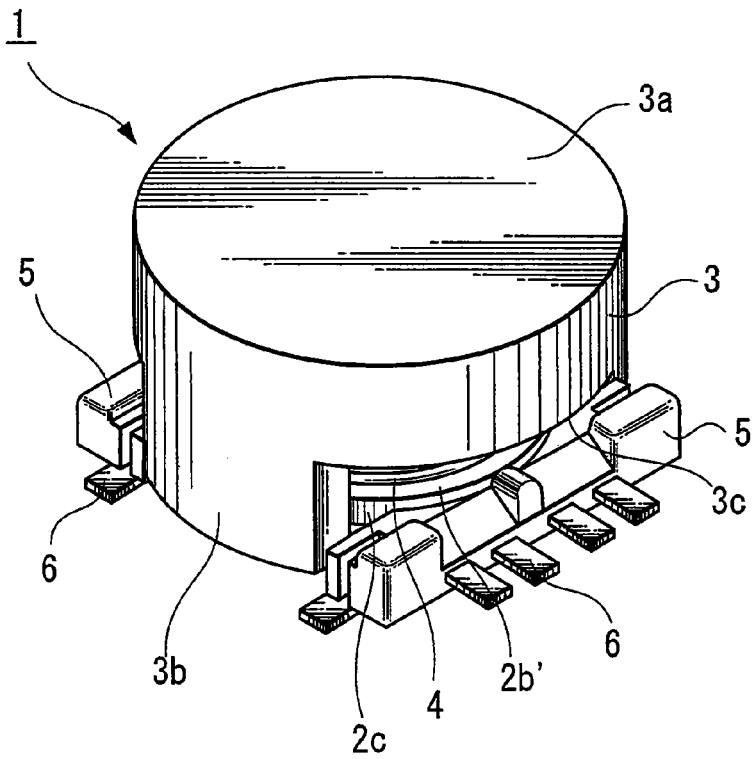
FIG. 4A is a perspective view of the coil component according to the embodiment of the present invention.

FIG. 4A is a perspective view of the coil component according to the embodiment of the present invention.

As shown in FIG. 4A, the coil component 1 is configured to have the flanged core 2 around which the coil 4 is wound, the resin base members 5 having the metal terminals 6 which are installed to the flanged core 2 and the bottomed cylindrical cup-shaped core 3.

The coil component 1 is assembled such that other portions in the lateral circumferential surface 2*c* of the flange portion 2*b*' of flanged core than those to which the resin base members 5 are installed oppose to an inner circumferential surface of the circumferential wall portion 3*b* of bottomed cylindrical cup-shaped core and have a gap portion g. Also, the coil component 1 is assembled such that the resin base members 5 are disposed at the positions corresponding to the cut-out portions 3*c* that are provided in the bottomed cylindrical cup-shaped core 3.

Figure 4B:
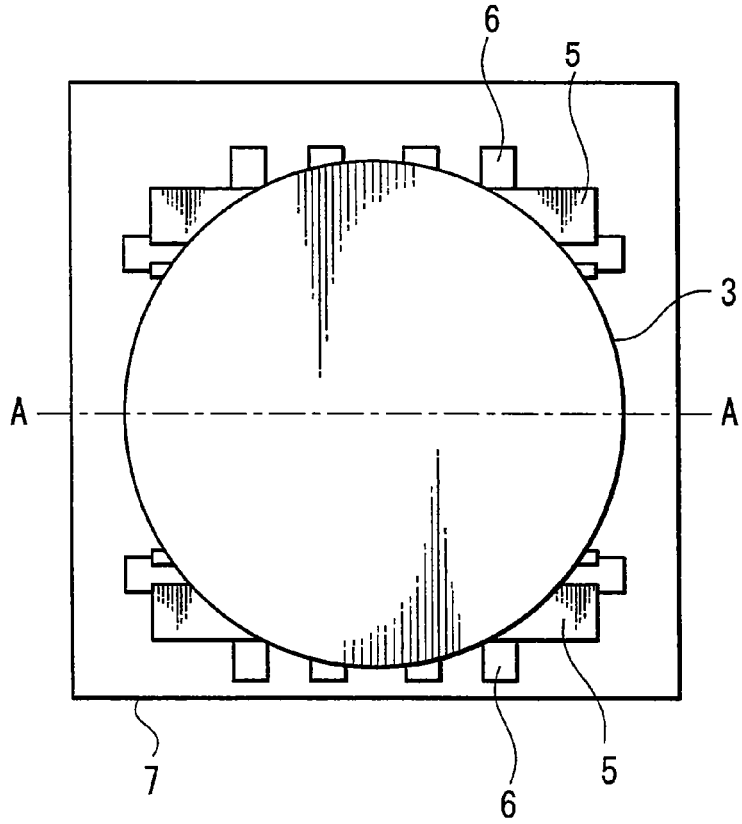
FIG. 4B is a plan when the coil component according to the embodiment of the present invention is viewed from an upper side.

FIG. 4B is a plan when the coil component according to the embodiment of the present invention is viewed from an upper side in a state being mounted on a circuit substrate.

As shown in FIG. 4B, the coil component 1 is mounted on the mounting substrate 7 by means of soldering and the like. In addition, the coil component 1 is mounted on the circuit substrate 7 in such a state that the bottom portion 3*a* of bottomed cylindrical cup-shaped core 3 covers a part of the resin base member 5 at the time of viewing the coil component 1 from the upper side since the resin base member 5 is disposed in a manner corresponding to the cut-out portion 3*c* of bottomed cylindrical cup-shaped core 3.

Thus, a mounting area for mounting on the circuit substrate can be reduced and the coil component can be miniaturized according to the coil component 1 of this embodiment since the cut-out portions 3*c* to accommodate the resin base members 5 at the time of assembly are provided in the circumferential wall portion 3*b* of bottomed cylindrical cup-shaped core 3.

Figure 5A:
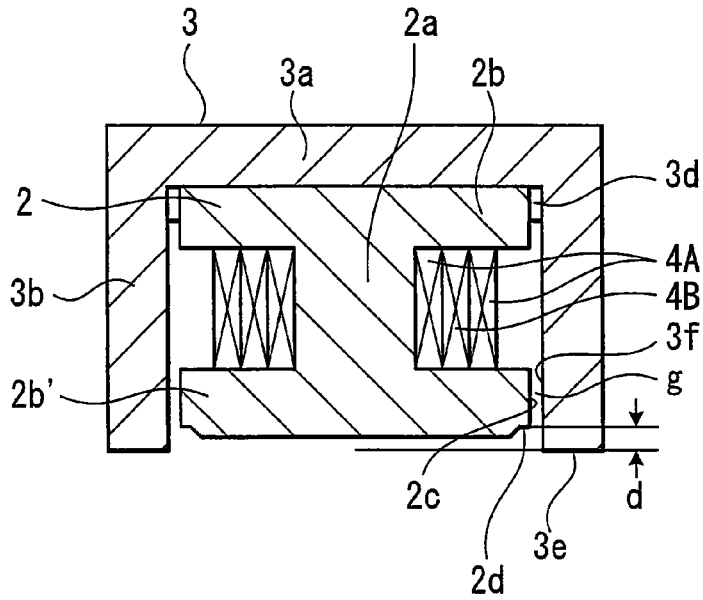
FIG. 5A is a cross-sectional view of the coil component according to the embodiment of the present invention.

FIG. 5A is a cross-sectional view of the coil component according to the embodiment of the present invention, which is taken on A-A line shown in FIG. 4B.

As shown in FIG. 5A, the primary coil 4A, the secondary coil 4B and further the primary coil 4A are wound into three layers around the winding core portion 2*a* of flanged core 2. The projection portion 3*d* is located between the upper side flange portion 2*b* of flanged core 2 and the circumferential wall portion 3*b* of bottomed cylindrical cup-shaped core 3, and the flanged core 2 is positioned to the bottomed cylindrical cup-shaped core 3 by this projection portion 3*d*. In addition, the gap portion g is formed between the lateral circumferential surface 2*c* of the lower side flange portion 2*b*' of flanged core 2 and an inner circumferential surface 3*f* of the bottomed cylindrical cup-shaped core 3.

Further, the lower side flange portion 2*b*' of flanged core 2 is made into a two-tiered structure having different diameters, and a level difference is formed in a lower end portion of lateral circumferential surface of the flange portion 2*b*'. A positioning accuracy can be improved by this level difference when the resin base member 5 is installed to the flanged core 2. It should be noted that the flange portion 2*b*' of flanged core 2 is made into the two-tiered structure in this embodiment but the flange portion 2*b*' needs not to be limited to this structure.

Since a height of a position of lower end surface 3*e* in the circumferential wall portion 3*b* of bottomed cylindrical cup-shaped core 3 and a height of a position of lower end surface 2*d* in a larger diameter side of flange portion 2*b*' are different from each other in a state that the flanged core 2 and the bottomed cylindrical cup-shaped core 3 are assemble together, a level difference d is formed between the lower end surface 3*e* of circumferential wall portion 3*b* and the flange portion 2*b*'. In other words, the bottomed cylindrical cup-shaped core 3 is formed such that the height of the circumferential wall portion 3*b* of bottomed cylindrical cup-shaped core 3 becomes higher than the height of the flanged core 2. Here, the height of the circumferential wall portion 3*b* of bottomed cylindrical cup-shaped core 3 means one that the height of the bottom portion 3*a* is subtracted from the overall height of the bottomed cylindrical cup-shaped core 3, and the height of the flanged core 2 means the height combining the height of the flange portion 2*b*, the height of the winding core 2*a* and the height of the larger diameter side of flange portion 2*b*'.

Figure 5B:
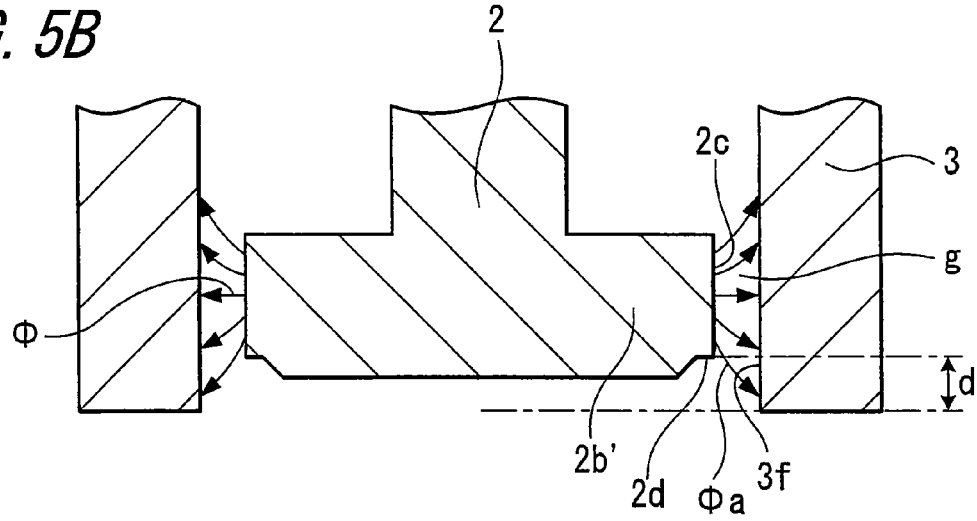
FIG. 5B is a schematic diagram showing an appearance of magnetic flux at a gap portion of coil component according to the embodiment of the present invention.

FIG. 5B is a schematic diagram showing an appearance of magnetic flux at the gap portion of coil component according to the embodiment of the present invention.

Magnetic flux Φ emitted from the lateral circumferential surface 2*c* of the lower side flange portion 2*b*' of flanged core is absorbed into the inner circumferential surface 3*f* of the bottomed cylindrical cup-shaped core 3 through the gap portion g. In addition, magnetic flux Φa passing through the lowest side and the vicinity thereof out of the magnetic flux Φ emitted form the flange portion 2*b*' is absorbed into the portion of level difference d that is formed in the circumferential wall portion 3*b* of bottomed cylindrical cup-shaped core 3. Here, a size of the level difference d is set into such a size that the circumferential wall portion 3*b* of bottomed cylindrical cup-shaped core 3 exists on an extended line of an inclination and forwarding direction of the magnetic flux Φa that is emitted from the flange portion 2*b*' and passes through the lowest side.

However, it is difficult to visually grasp the inclination and forwarding direction of the magnetic flux Φa that passes through the lowest side at the time of determining a suitable value of the level difference d. Then, when an inductance value is put as $L_0$ at the time of setting to the height of the circumferential wall portion 3*b* of bottomed cylindrical cup-shaped core 3=the height of the flanged core 2 and an inductance value is put as L at the time of changing the height of the circumferential wall portion 3*b* of bottomed cylindrical cup-shaped core 3 and the height of the flanged core 2, and in case that the inductance value L at the time of changing the height of the circumferential wall portion 3*b* of bottomed cylindrical cup-shaped core 3 and the height of the flanged core 2 becomes larger than $L_0$, it is judged in this embodiment that the magnetic flux Φa is absorbed by the portion of level difference d in the circumferential wall portion 3*b* of bottomed cylindrical cup-shaped core and a leakage of magnetic flux is suppressed.

As a result thereof, it is confirmed that the inductance value L tends to become larger than $L_0$ and the leakage of magnetic flux is suppressed when a condition is set to the height of the circumferential wall portion 3*b* of bottomed cylindrical cup-shaped core 3>the height of the flanged core 2. It should be noted that 100 μm which is an added value of a tolerance in height dimension of the bottomed cylindrical cup-shaped core 3 and a tolerance in height dimension of the flanged core 2 is set as a lower limit value of the level difference d in this embodiment since a tolerance of core dimension ±50 μm needs to be considered generally when a sintered core is used.

Moreover, it becomes clear that an improvement of the inductance value L becomes the maximum against the inductance value $L_0$ and the leakage of magnetic flux is suppressed most efficiently when the level difference d is approximately 20% of the height of the flanged core 2 (more specifically, when the height of the circumferential wall portion 3*b* of bottomed cylindrical cup-shaped core 3 is the height of the flanged core 2×1.2 times). Even if the size of the level difference d is further increased thereafter, an increase in the inductance value: L is not recognized and therefore the value that satisfies the condition of the level difference d<20% of the height dimension of the flanged core 2 is determined as the upper limit value of the level difference d in this embodiment. Accordingly, the level difference d is set into a range that satisfies a relational expression of 100 μm<level difference d<20% of height dimension of flanged core 2 in this embodiment.

Thereby, it is possible to improve an electric current efficiency of the coil component 1 since a useless magnetic flux leakage generated at the gap portion can be suppressed by absorbing the magnetic flux Φa passing through the lowest side into the circumferential wall portion 3*b* of bottomed cylindrical cup-shaped core 3 according to the coil component 1 of this embodiment.

Figure 6A:
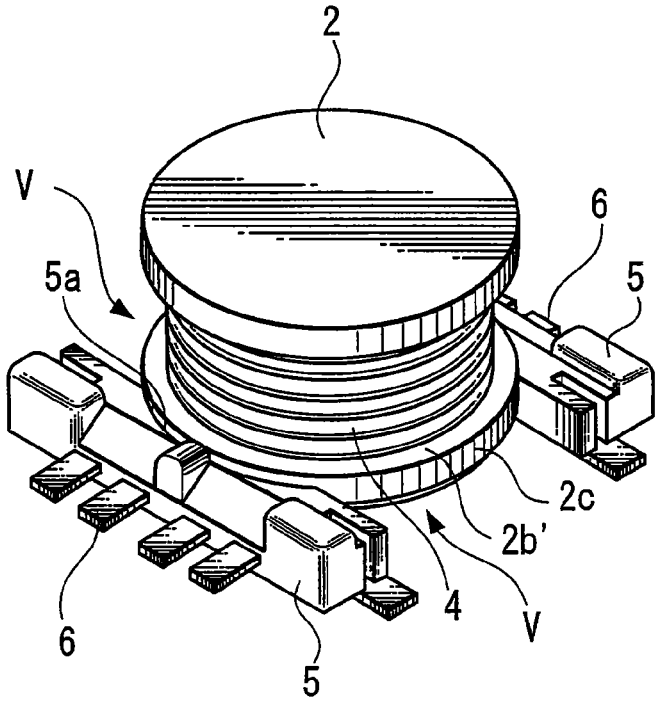
FIG. 6A is a perspective view when a bottomed cylindrical cup-shaped core is removed from the coil component according to the embodiment of the present invention.

FIG. 6A is a perspective view when the bottomed cylindrical cup-shaped core is removed from the coil component according to the embodiment of the present invention. Here, in FIG. 6A, the same reference numerals are given to those corresponding to FIG. 4A and duplicated explanations thereof are omitted.

As shown in FIG. 6A, two sets of resin base members 5 having symmetrical shapes are installed to the lateral circumferential surface 2*c* of the flange portion 2*b*' in a manner being disposed at symmetrical positions across the flanged core 2. At this time, the resin base members 5 are installed to the flanged core 2 such that the shape of the cut-out portion 5*a* molded in the resin base member 5 fits to the shape of the lateral circumferential surface 2*c* of flange portion 2*b*'. A space portion v is formed between the mutually opposing resin base members 5 installed to the lateral circumferential surface 2*c* so that the circumferential wall portion 3*b* of bottomed cylindrical cup-shaped core 3 is disposed therein when the bottomed cylindrical cup-shaped core 3 is assembled together.

Figure 6B:
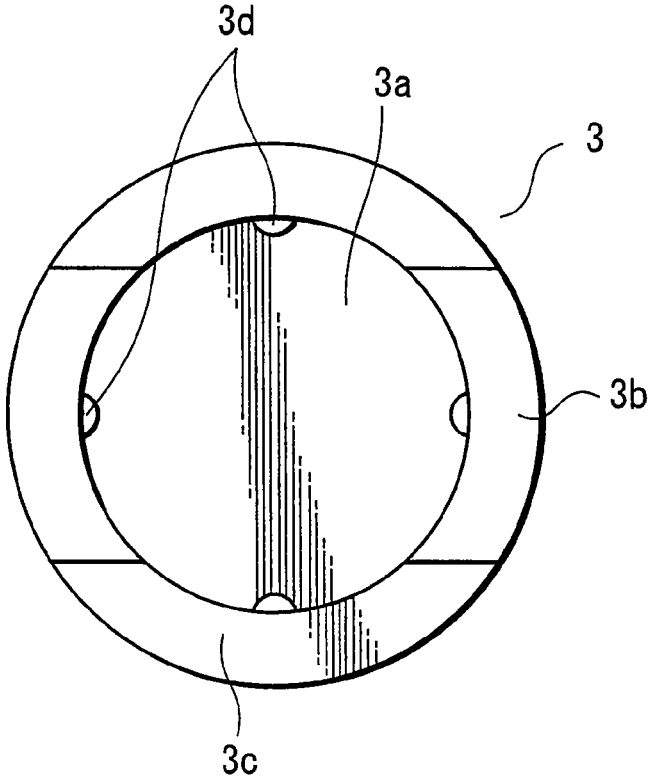
FIG. 6B is a plan when the inside of the bottomed cylindrical cup-shaped core used in the embodiment of the present invention is viewed from a lower side.

FIG. 6B is a plan when an inner side of the bottomed cylindrical cup-shaped core used in the embodiment of the present invention is viewed from a lower side.

As shown in FIG. 6B, the projection 3 is formed in a manner stretching over the bottom portion 3*a* and the circumferential wall portion 3*b*, and four pieces of projection portions 3*d* are disposed at equal intervals along an inner circumferential surface of the bottomed cylindrical cup-shaped core 3.

Since the projection portions 3*d* of at least three places or more are formed in the bottomed cylindrical cup-shaped core 3 according to the coil component 1 of this embodiment, a relative positional accuracy between the flanged core 2 and the bottomed cylindrical cup-shaped core 3 improves when the flanged core 2 is accommodated in the bottomed cylindrical cup-shaped core 3, and it is possible to manage accurately a dimension of the gap portion g that is created between the flanged core 2 and the bottomed cylindrical cup-shaped core 3. In addition, since the projection portions 3*d* are provided in the manner stretching over the bottom portion 3*a* and the circumferential wall portion 3*b*, it is possible to accommodate the bottomed cylindrical cup-shaped core 3 while maintaining accurately a parallelism of the flange portion 2*b* to the bottom portion 3*a* and an installation accuracy of the bottomed cylindrical cup-shaped core 3 can be improved when the bottomed cylindrical cup-shaped core 3 is installed to the flanged core 2.

It should be noted that the magnetic material used for forming the flanged core 2 and the bottomed cylindrical cup-shaped core 3 is not limited to Ni—Zn type ferrite but it is possible to use Mn—Zn type ferrite, metal type magnetic material, and pulverized material made of amorphous type magnetic material.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A coil component comprising:

a flanged core having a flange portion on at least one end portion of a winding core;

a coil wound around said winding core;

a bottomed cylindrical cup-shaped core consisting of a bottom portion and a circumferential wall portion; and at least two or more resin base members, each resin base member having metal terminals, wherein, cut-out portions of at least two places or more are formed in said circumferential wall portion of the bottomed cylindrical cup-shaped core to partially accommodate said two or more resin base members, respectively, when attaching the two or more resin base members to said flange portion, each of said two or more resin base members has a concave portion fittingly matching a lateral circumferential part of said flange portion, and is attached to said flange portion with the corresponding lateral circumferential part engaged with said fittingly matching portion of said resin base member, and a bottom surface of said circumferential wall portion of the bottomed cylindrical cup-shaped core is lower than that of said flange portion.

2. A coil component according to claim 1, wherein a height of said circumferential wall portion of bottomed cylindrical cup-shaped core is larger than a height of said flanged core.

3. A coil component according to claim 1, wherein projection portions stretching over a circumferential wall portion and a bottom surface portion are provided to at least three places or more in said bottomed cylindrical cup-shaped core.

4. A coil component according to claim 2, wherein projection portions stretching over a circumferential wall portion and a bottom surface portion are provided to at least three places or more in said bottomed cylindrical cup-shaped core.

* * * * *